United States Patent [19]

Player

[11] Patent Number: 4,476,659

[45] Date of Patent: * Oct. 16, 1984

[54] INSULATED ROOFING SYSTEM WITH SLIDABLE ROOF TO CEILING CLIPS

[76] Inventor: Wayne H. Player, Rte. 1, Box 984-A, Mesquite, Tex. 75181

[ * ] Notice: The portion of the term of this patent subsequent to Feb. 16, 2000 has been disclaimed.

[21] Appl. No.: 275,656

[22] Filed: Jun. 22, 1981

[51] Int. Cl.³ ..... E04B 1/62

[52] U.S. Cl. ..... 52/404; 52/489; 52/713; 52/484

[58] Field of Search ..... 52/404, 484, 485, 486, 52/489, 712, 713, 741, 743; 24/201 E, 201 C

[56] References Cited

U.S. PATENT DOCUMENTS

| | | | |
|---|---|---|---|
| 3,952,470 | 4/1976 | Byrd | 52/404 X |
| 4,038,799 | 8/1977 | Shanks | 52/404 X |
| 4,135,342 | 1/1979 | Cotten | 52/404 X |
| 4,155,206 | 5/1979 | Player | 52/404 X |
| 4,160,344 | 7/1979 | Bragman | 52/484 X |
| 4,255,910 | 3/1981 | Wendt | 52/489 X |

*Primary Examiner*—J. Karl Bell

[57] ABSTRACT

The present invention establishes an insulation cavity by connecting rail tracks to the roofing panels, slidably engaging adjustable suspension clips within said tracks, and connecting ceiling panels to the depending end of the suspension clips. The suspension clips are slidable within these track connections to allow the relative displacement between the roof and the depending ceiling. This freedom allows flexability in the alignment of the ceiling panels in relation to the roofing panels and thereby simplifies installation procedures. Further, the deliberate thermal isolation of the connected roof and ceiling panels promotes the relative displacement therebetween due to thermal expansion and this displacement translates to potentially damaging strain within the roofing system in the absence of the freedom provided by the clip to track engagement. It is preferred that the suspension clips be adjustable with respect to the distance between the roof and the suspended ceiling in order to accomodate differing desired insulative materials and differing desired thermal resistance. The disclosure teaches connection means that are quickly and easily engagable to the underside of the roofing panels and to the top side of the ceiling panels, are installable without special tools, and do not require that any holes be passed through the shelter portion of the roofing panels.

6 Claims, 3 Drawing Figures

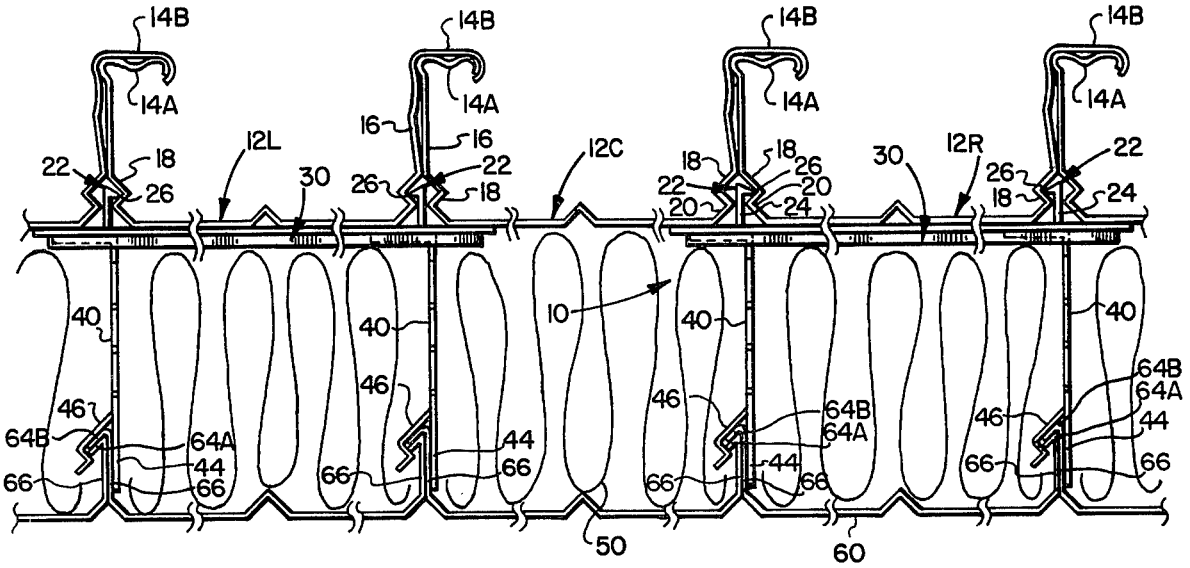
FIG. 1
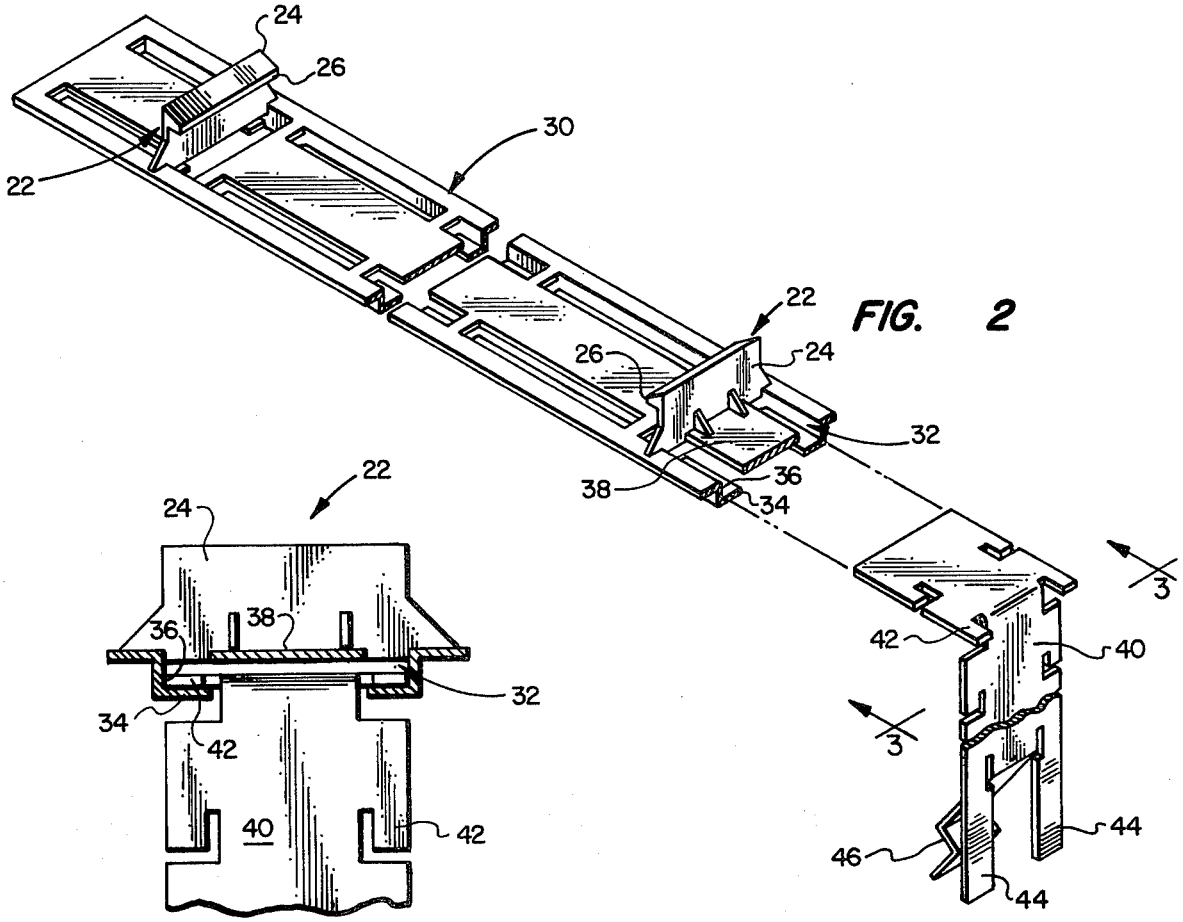
FIG. 2
FIG. 3

INSULATED ROOFING SYSTEM WITH SLIDABLE ROOF TO CEILING CLIPS

BACKGROUND

There is presently a great demand for economically and easily installed roofing systems suitable for rooms added to existing residential construction. Among the qualities desired in a roofing system in such an application are that it be economically, quickly, and easily installed; that it require a minimum of maintenance and that it provide an effective barrier to weather. Further, increases in energy costs have accentuated the need for the roofing system to provide an effective thermal barrier. In fact, increased heating and air conditioning costs have made the presence of insulation between the roof and the ceiling a necessity, even in moderate climates, for economical year-round enjoyment.

One roofing system that particularly provides for convenient and economical installation of an insulated roof is disclosed in U.S. Pat. No. 4,155,206. However, the roofing system disclosed there shares a deficiency with other insulated roofing systems prior to the present invention in that it fails to address two problems.

A significant improvement over prior roofing systems is herein provided by an economical and rapidly installing insulated roofing system that eases alignment requirements of roof and ceiling installation and which provides for differences in thermal expansion between the roof and the ceiling due to differences in temperature, material and configuration.

SUMMARY OF THE INVENTION

The present invention defines an insulation cavity by connecting rail tracks to the roofing panels, slidably engaging adjustable suspension clips within said tracks, and connecting ceiling panels to the depending end of the suspension clips. The suspension clips are slidable within these track connections to allow the relative displacement between the roof and the depending ceiling. It is this freedom which allows flexability in the alignment of the ceiling panels in relation to the roofing panels and thereby simplifies installation procedures. This becomes particularly important in the installation of insulated roofs across larger expanses in which tolerences that present no problems in smaller applications tend to stack up through the increased number of panels and thereby produce significant misalignment of roofing to ceiling panels. Further, the deliberate thermal issolation of the connected roof and ceiling panels promotes the relative displacement therebetween due to thermal expansion and this displacement translates to potentially damaging strain within the roofing system in the absence of the freedom provided by the clip to track engagement. These latter considerations become significant because of the relatively high coefficient of expansion in popularly used materials such as aluminum.

Installation of a roofing system in accordance with the present invention begins with the interconnection of a section of roofing panels to establish at least some portion of the exteior roof of the structure. The clip rails are then attached to the underside of the roofing panels.

The clip rails depend from the roofing panels and present tracks into which the first ends of the suspension clips slidingly engage. The other ends of the suspension clips engage ceiling panels, and this connection establishes a cavity or void into which insulation is placed.

Further, it is preferred that the suspension clips be adjustable with respect to the distance between the roof and the suspended ceiling in order to accomodate varying combinations of insulative materials and desired thermal resistance.

The exact configurations of the connection means between the roofing panels and the slidable hanger members and between the ceiling panels and the slidable hanger members vary depending upon the particular configuration of those roofing and ceiling panels. However it is desired that each variation include connection means that are quickly and easily engagable to the underside of the roofing panels and to the top side of the ceiling panels, are installable without special tools, and do not require that any holes be passed through the shelter portion of the roofing panels.

BRIEF DESCRIPTION OF THE DRAWINGS

FIG. 1 illustrates a cross-section of a roofing system incorporating a hanger assembly constructed in accordance with the present invention;

FIG. 2 illustrates an exploded view of a clip rail and a suspension clip of a slidable hanger assembly constructed in accordance with the present invention; and FIG. 3 is an end elevational view of a clip rail and suspension clip constructed in accordance with the present invention as viewed from line 3—3 of FIG. 2.

DETAILED DESCRIPTION OF THE PREFERRED EMBODIMENT

FIG. 1 illustrates slidable hanger clip assembly 10 of the present invention interconnecting roofing panels 12 to ceiling panels 60. In the illustrated embodiment roofing panels 12 are channel shaped panels interlocked by intertwining curled flanges 14A and 14B which are set atop legs 16. Each of these roofing panels carries these two flanges disposed on opposing lateral edges as inside and outside flanges 14A and 14B, respectively.

The center roofing panel of FIG. 1 is representative of this roofing system and has been designated 12C. On its left, panel 12C is connected to roofing panel 12L and on its right, roofing panel 12C is connected to panel 12R. The right side connection of roofing panel 12C is formed by outside flange 14B of panel 12C which wraps around and thereby interlocks with inside flange 14A of panel 12R. Correspondingly, the left side of roofing panel 12C presents inside flange 14A to which outside flange 14B of roofing panel 12L interlocks.

The interconnected roofing panels of the illustrated configuration present opposing detents 18 at the bases of adjoining flange supporting legs 16 and a narrow channel is formed by bevels 20 as access to these detents. See both FIGS. 1 and 2. Returning to the assembly, FIG. 1, detent daggers 22 snap into detents 18 to securely attach clip rails 30 to an assembly of roofing panels. Detent daggers 22 are carried upon arms 24 and are locked into detents 18 by flanges 26. The clip rails of the preferred embodiment each carry two detent daggers, the flanges of which project toward each other. These daggers are disposed to engage detents 18 on opposite sides of the same roofing panel to attach said clip rails transversely across the roofing panel and this attachment is repeated with other rail clips on alternating roofing panels. This produces a particularly convenient connection means by which the slidable hanger assembly is simply yet securely snapped into place beneath the roofing panels.

FIG. 2 illustrates in detail one of clip rails 30 showing track 32 into which suspension clip 40 slidingly engages. This track is defined by median 38 on top and depressed opposing arms 34 which depending upon shoulders 36 on the bottom and lateral edges, respectively. This engagement is also detailed in FIG. 3.

Elongated suspension clip 40 has track engaging means on the forward end and ceiling panel engaging means on the other end which depends from track 32 when clip 40 is suspended by its connection to roof panels 12 through clip rails 30. In the preferred embodiment, suspension clip 40 has laterally and rearwardly extending pairs of tabs 42 at regular intervals along opposite sides of the clip body. Each of these tabs represents a possible adjustment in the depth of the ceiling insulation. The main body of clip 40 in FIG. 2 has been folded to a right angle at the beginning of the rearward extensions of one of the pairs of tabs 42, thus providing that the projections of the tabs extend horizontally beyond the downward turn of the clip. This configuration ensures that the load upon the suspension clip does not twist and thereby bind the clip within its tracks to prevent its sliding freedom.

The ceiling engaging elements of the suspension clip in the preferred embodiment are extension arms 44 on either side of prong 46. Prong 46 is a cantilevered leaf spring disposed to engage flanges 64 of ceiling panels 60. It is convenient that ceiling panels have upstanding legs 66 with flanges 64 extending therefrom, here disposed as inside and outside flanges 64A and 64B, respectively. The inside flange of one ceiling panel rests within the outside flange of the adjacent ceiling panel and this nested pair push-snaps into reception between prong 46 and extensions 44. This assembly provides for easy installation without any special tools and, in this configuration, provides the additional advantage of slidably engaging the ceiling panels in a manner supplementing at right angles the freedom of the track to suspended clip engagement. Supplementary freedom is also provided by the clip rail to roofing panel connection in the preferred embodiment. These supplementary freedoms, together with the freedom provided by the slidable engagement of the suspension clip within the clip rail track, amply provides for thermal expansion and contraction in the roofing system disclosed herein.

The first step in installing an insulated roofing system constructed in accordance with the present invention is to install roofing panels 12 into place. FIG. 1 illustrates the preferred embodiment, and in this view, the roofing panels are sequentially placed from left to right, wraping outside flanges 14B about inside flange 14A of the last previously placed roofing panel 12. The interlocked roofing panels present a receiving means for attaching slidable hanger assembly 10. In the preferred embodiment, the receiving means is formed from bevels 20 leading to detents 18.

Next, an array of clip rails 30 is fastened into place by pressing detent daggers 22, which are carried on the top side of the clip rails, into detents 18 through bevels 20 presented at the underside of adjoining roofing panels 12. Each clip rail attaches across one ceiling panel, engaging either side of it and this is repeated with rail clips on alternating roofing panels at each interval along the length of panels 12 where an additional row of slidable ceiling hanger assemblies is needed.

Each suspension clip 40 is bent to a right angle at the base of a pair of tabs 42 in order to establish the depth of the insulation cavity between the roof and the ceiling to be suspended therefrom. The forward end of the orthogonal suspension clips are then slid into reception within tracks 32 on the underside of clip rails 30 and aligned as necessary to attach ceiling panels 60.

In the view of the preferred embodiment in FIG. 1, ceiling panels 60 are sequentially installed from right to left. A first ceiling panel is attached by pressing flanges 64 between extensions 44 and prongs 46 and the inside flanges 64B of subsequent ceiling panels are nested into this reception within outside flange 64A of the last preceding ceiling panel to be installed.

Insulation 50 is then deposited into the cavity formed between the roof and ceiling.

I claim:

1. A slidable hanger assembly for use in insulatable roofing structures having interlocking elongated roofing panels and interlocking ceiling panels, said roofing and ceiling panels being connectable by multiplicity of slidable hanger assemblies, said slidable hanger assemblies comprising:

a clip rail having means on its top side for attaching to the underside of said interlocking roofing panels;

an elongated clip receiving track on the bottom side of said clip rail; and an elongated suspension clip having a first end slidably engagable in said track of said clip rail and having a second end connectable to said ceiling panels, which said second end is provided with mobility of the slidable engagement of said first end within said track;

whereby said ceiling panels are suspendable from said roofing panels in a manner that allows the relative misalignment of the roofing panels with respect to the ceiling panels.

2. A slidable hanger assembly constructed in accordance with claim 1 in which said suspension clip comprises:

an elongated main body; and pairs of tabs on the lateral edges of said main body, said tabs extending outwardly and rearwardly;

whereby said main body is bendable at the base of a selected pair of said tabs to a right angle, one leg of which is slidably engagable in said track, the other leg of which depends to present means for attaching the ceiling panels.

3. A slidable hanger assembly constructed in accordance with claim 1 in which said clip rail comprises:

an elongated main body;

inwardly facing detent daggers projecting upon arms from the top side of said main body;

a median region of said main body defining the top of a track;

shoulders depending from the main body at the lateral edges of said median defining the edges of said track; and arms extending inwardly from said shoulders defining the bottom of said track with an open center between said opposing arms.

4. In an insulatable metal roofing structure having elongated channel shaped roofing members with interlockable flanges extended upon upright legs in which said legs have detent grooves at their bases positioned to establish a tubelike detent space between adjacent interlocking roofing members that is accessable through a beveled slot and in which channel shaped ceiling panels having flanged upright legs the ceiling suspension means comprising:

a clip rail comprising:

a main body;

inwardly facing detent daggers projecting upon arms from the top side of said main body; and a longitudinal track defined on the underside of said main body, said track having a median on top and depressed opposing arms depending upon shoulders to form the bottom and sides of said track, leaving an open center between said opposing arms;

an elongated suspension clip having a first end slidably engagable in said track of said rail clip and having a second end connectable to said ceiling panels, said suspension clip comprising:

an elongated bendable main body; and pairs of tabs on the lateral edges of said first end of said main body, said tabs extending outwardly and rearwardly;

whereby said main body is bendable at the base of any one pair of said tabs to a right angle, the first end of which is engagable in said track; and a trifurated second end having extensions on either side of a prong whereby said suspension clip grasps said flange of said ceiling panel.

5. A method of installing an insulatable roofing structure having elongated roofing panels with interlockable flanges, and having interlockable elongated ceiling panels the steps of installation comprising:

installing interlocking roofing panels into place;

attaching clip rails to the underside of said roofing panels;

slidably engaging one end of orthogonal suspension clips into elongated tracks on the underside of said rails and depending the other end of said suspension clip downward from said track;

connecting said ceiling panels to the depending end of said suspension clips; and inserting insulation into a cavity established between said roofing panels and said ceiling panels.

6. A method of installing an insulatable metal roofing structure having elongated channel shaped roofing panels with interlockable flanges extended upon upright legs, in which said legs have detent grooves at their bases positioned to establish a tubelike detent space between adjacent interlocking roofing members that is accessible through a beveled slot, and in which channel shaped ceiling panels having flanged upright legs;

the steps of installation comprising:

installing interlocking roofing panels into place;

attaching clip rails to the underside of said roofing panels by snapingly engaging detent daggers of said clip rails through said bevels and into said detent grooves;

bending suspension clips to a right angle in order to select a desired thickness of the cavity between said roofing panels and said ceiling panels to correspond with the desired insulation thickness;

slidably engaging one end of the orthogonal suspension clips into tracks on the underside of said rails and depending the other end of said suspension clip downward from said track;

connecting said ceiling panels to the depending end of said suspension clips by grouping the flanges on the upright legs of said ceiling panels; and inserting insulation into a cavity established between said roofing panels and said ceiling panels.

* * * * *

UNITED STATES PATENT AND TRADEMARK OFFICE

CERTIFICATE OF CORRECTION

PATENT NO. : 4,476,659

DATED : October 16, 1984

INVENTOR(S) : Wayne H. Player

It is certified that error appears in the above-identified patent and that said Letters Patent is hereby corrected as shown below:

The title page should be deleted to appear as per attached title page.

Signed and Sealed this

*Twenty-sixth* Day of *November 1985*

[SEAL]

*Attest:*

DONALD J. QUIGG

*Attesting Officer*

*Commissioner of Patents and Trademarks*

United States Patent [19]

Player

[11] Patent Number: 4,476,659

[45] **Date of Patent: * Oct. 16, 1984**

[54] INSULATED ROOFING SYSTEM WITH SLIDABLE ROOF TO CEILING CLIPS

[76] Inventor: Wayne H. Player, Rte. 1, Box 984-A, Mesquite, Tex. 75181

[ * ] Notice: The portion of the term of this patent subsequent to Feb. 16, 2000 has been disclaimed.

[21] Appl. No.: 275,656

[22] Filed: Jun. 22, 1981

[51] Int. Cl.[3] ..... E04B 1/62

[52] U.S. Cl. ..... 52/404; 52/489; 52/713; 52/484

[58] Field of Search ..... 52/404, 484, 485, 486, 52/489, 712, 713, 741, 743; 24/201 E, 201 C

[56] References Cited

U.S. PATENT DOCUMENTS

| | | | |
|---|---|---|---|
| 3,952,470 | 4/1976 | Byrd | 52/404 X |
| 4,038,799 | 8/1977 | Shanks | 52/404 X |
| 4,135,342 | 1/1979 | Cotten | 52/404 X |
| 4,155,206 | 5/1979 | Player | 52/404 X |
| 4,160,344 | 7/1979 | Bragman | 52/484 X |
| 4,255,910 | 3/1981 | Wendt | 52/489 X |

*Primary Examiner*—J. Karl Bell

[57] ABSTRACT

The present invention establishes an insulation cavity by connecting rail tracks to the roofing panels, slidably engaging adjustable suspension clips within said tracks, and connecting ceiling panels to the depending end of the suspension clips. The suspension clips are slidable within these track connections to allow the relative displacement between the roof and the depending ceiling. This freedom allows flexability in the alignment of the ceiling panels in relation to the roofing panels and thereby simplifies installation procedures. Further, the deliberate thermal isolation of the connected roof and ceiling panels promotes the relative displacement therebetween due to thermal expansion and this displacement translates to potentially damaging strain within the roofing system in the absence of the freedom provided by the clip to track engagement. It is preferred that the suspension clips be adjustable with respect to the distance between the roof and the suspended ceiling in order to accomodate differing desired insulative materials and differing desired thermal resistance. The disclosure teaches connection means that are quickly and easily engagable to the underside of the roofing panels and to the top side of the ceiling panels, are installable without special tools, and do not require that any holes be passed through the shelter portion of the roofing panels.

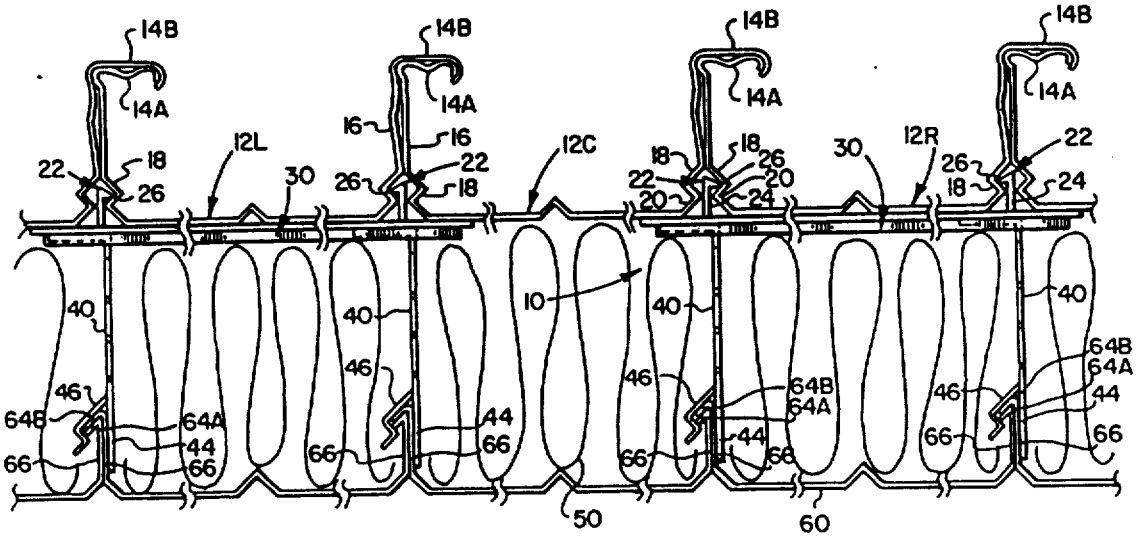

6 Claims, 3 Drawing Figures